US011788487B2

(12) United States Patent
Sliwa

(10) Patent No.: US 11,788,487 B2
(45) Date of Patent: Oct. 17, 2023

(54) CYLINDER HEAD INCLUDING A CAST-IN WATER PUMP AND INTEGRATED THERMOSTAT

(71) Applicant: DEUTZ Aktiengesellschaft, Cologne (DE)

(72) Inventor: Marco Sliwa, Siegburg (DE)

(73) Assignee: Deutz Aktiengesellschaft, Cologne (DE)

( * ) Notice: Subject to any disclaimer, the term of this patent is extended or adjusted under 35 U.S.C. 154(b) by 0 days.

(21) Appl. No.: 17/763,982

(22) PCT Filed: Sep. 17, 2020

(86) PCT No.: PCT/EP2020/000159

§ 371 (c)(1),
(2) Date: Mar. 25, 2022

(87) PCT Pub. No.: WO2021/058125

PCT Pub. Date: Apr. 1, 2021

(65) Prior Publication Data

US 2022/0341372 A1 Oct. 27, 2022

(30) Foreign Application Priority Data

Sep. 27, 2019 (DE) ..... 102019006790.8

(51) Int. Cl.

| | |
|---|---|
| ***F01P 5/10*** | (2006.01) |
| ***F02F 1/40*** | (2006.01) |
| ***F01P 3/02*** | (2006.01) |

(52) U.S. Cl.

CPC ..... *F02F 1/40* (2013.01); *F01P 3/02* (2013.01); *F01P 5/10* (2013.01); *F01P 2003/024* (2013.01); *F02F 2200/06* (2013.01)

(58) Field of Classification Search

CPC .. F02F 1/40; F02F 2200/06; F02F 1/38; F02F 1/24; F01P 3/02; F01P 5/10; F01P 2003/024; F01P 7/16; F02B 67/04; F04D 29/426; F04D 29/605; F04D 29/628

See application file for complete search history.

(56) References Cited

U.S. PATENT DOCUMENTS

| | | | | |
|---|---|---|---|---|
| 1,464,568 A * | 8/1923 | Gunn | ..... | F01P 5/12 123/41.46 |
| 4,662,320 A | 5/1987 | Moriya et al. | | |
| 5,216,984 A * | 6/1993 | Shimano | ..... | F01L 1/02 123/198 C |
| 6,280,158 B1 * | 8/2001 | Itoh | ..... | F01L 1/053 417/423.8 |

(Continued)

FOREIGN PATENT DOCUMENTS

| | | | |
|---|---|---|---|
| CN | 1534177 A | * | 10/2004 |
| CN | 201209472 Y | * | 3/2009 |

(Continued)

OTHER PUBLICATIONS

International Search Report for PCT/EP2020/000159, dated Dec. 16, 2020.

*Primary Examiner* — Hung Q Nguyen

(74) *Attorney, Agent, or Firm* — Davidson, Davidson & Kappel, LLC

(57) ABSTRACT

An internal combustion engine is provided, including at least one cylinder head including a water pump that is cast into the cylinder head housing.

19 Claims, 3 Drawing Sheets

(56) References Cited

U.S. PATENT DOCUMENTS

| | | | |
|---|---|---|---|
| 2002/0056433 | A1 | 5/2002 | Nabeya et al. |
| 2010/0162974 | A1 | 7/2010 | Yamanishi et al. |
| 2019/0383214 | A1 | 12/2019 | Dembinski et al. |

FOREIGN PATENT DOCUMENTS

| | | | | | |
|---|---|---|---|---|---|
| CN | 201486640 | U | * | 5/2010 | |
| DE | 3517002 | A1 | | 11/1985 | |
| DE | 10117090 | A1 | * | 10/2002 | ..... F01P 7/16 |
| DE | 10129933 | A1 | * | 1/2003 | ..... B62M 7/00 |
| DE | 4481079 | B4 | * | 2/2004 | ..... F01P 5/10 |
| DE | 102007004419 | A1 | * | 7/2008 | ..... F01P 5/04 |
| DE | 10 2010 050 261 | B3 | | 5/2012 | |
| EP | 0505346 | B1 | * | 12/1994 | |
| EP | 1645745 | A1 | * | 4/2006 | ..... F02F 1/38 |
| EP | 1953377 | A2 | * | 8/2008 | ..... F01P 5/04 |
| FR | 2966876 | A1 | | 5/2012 | |
| GB | 1567303 | A | | 5/1980 | |
| GB | 2134594 | A | * | 8/1984 | ..... F01P 5/10 |
| GB | 2160588 | A | * | 12/1985 | ..... F01L 1/053 |
| JP | 03105015 | A | * | 5/1991 | |
| JP | H05141239 | A | * | 6/1993 | |
| JP | H09501755 | A | * | 2/1997 | |
| JP | 2001263066 | A | * | 9/2001 | ..... F01P 3/02 |
| JP | 2017125467 | A | * | 7/2017 | ..... F01P 5/10 |
| KR | 930013428 | A | * | 7/1993 | |
| WO | WO-2005005803 | A1 | * | 1/2005 | ..... F01P 3/02 |
| WO | WO 2018/158272 | A1 | | 9/2018 | |

* cited by examiner

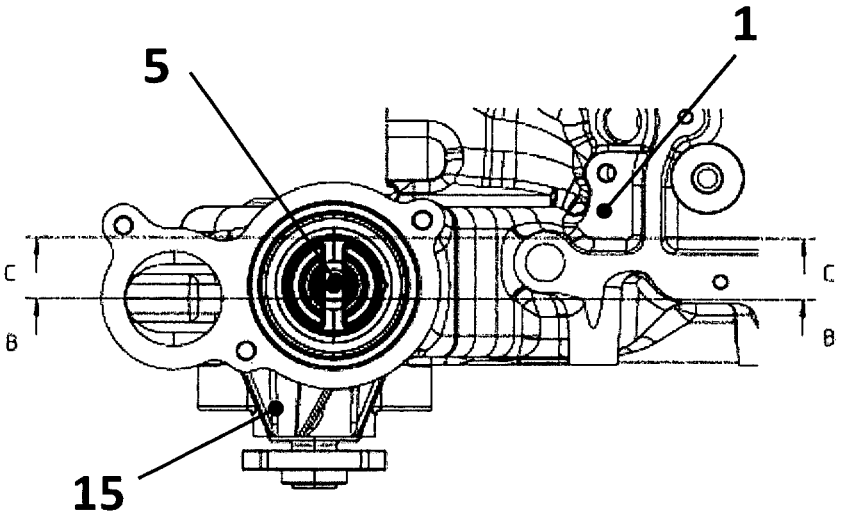
Fig. 3
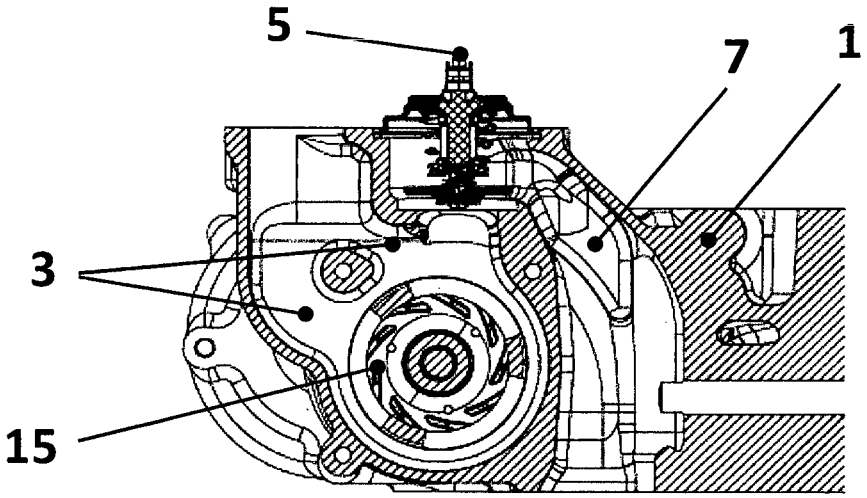
Fig. 4 (Section B-B)

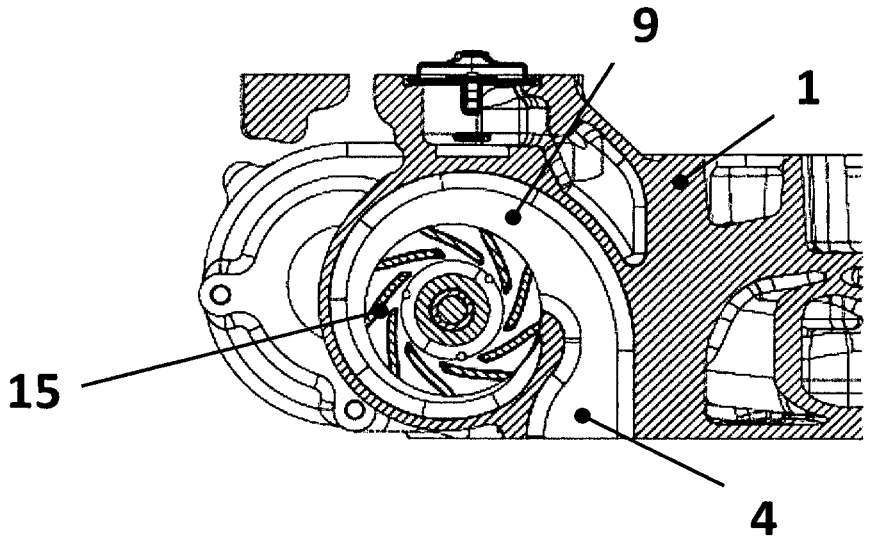
Fig. 5 (Section C-C )
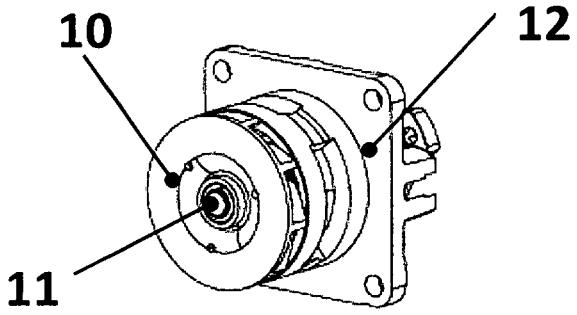
Fig. 6

CYLINDER HEAD INCLUDING A CAST-IN WATER PUMP AND INTEGRATED THERMOSTAT

The present disclosure relates to a coolant pump for internal combustion engines that is driven mechanically by a belt pulley, a gear wheel, a plug-in shaft or the like and that is controllable with the aid of a valve spool.

BACKGROUND

DE 35 17 002 A1 shows a water cooled internal combustion engine, in which the water pump is connected directly with the camshaft of the internal combustion engine and is driven by same.

In DE 10 2010 050 261 (B3), a mechanically driven controllable coolant pump is shown that significantly reduces the pollutant emission as well as the friction losses and the fuel consumption in the entire working range of the engine and that is in addition manufacturable easily, cost-effectively, and with minimum effort in terms of production and assembly, without the use of additional electric auxiliary pumps as well as without the installation of additional actuators and also without an oversized coolant pump, i.e., having less driving power, ensuring the cooling of specific components, such as for example the exhaust gas recirculation system, of the exhaust manifold, of the heater, etc., in the case of standing cooling water in the cylinder crankcase and in the cylinder head at a high degree of operational safety and reliability at high efficiency, and still making possible a simple and cost-effective integration in the engine management at the same time. The valve spools that are displaceably mounted in the pump housing and that have flow openings and an additional bypass pipe merging into the spool working chamber are characterized in that at the spool back wall of the valve spool a thrust washer is situated or the spool back wall itself is designed as a thrust washer, and one/multiple contact surface(s) is/are situated at the pump housing opposite to this thrust washer on the belt pulley side, and in the pump housing one/multiple outlet opening(s) that are enclosed by this/these contact surface(s) and that merge(s) into the bypass pipe is/are situated, and in the case of an impeller outlet that is completely unblocked by the outside cylinder of the valve spool the thrust washer directly or indirectly engages in an operative connection with the contact surface(s) at the pump housing and thus closes off the outlet opening(s).

WO 2018/158272 A1 shows a water pump that is situated on the front side of the crankcase and is driven by a belt. In this case, it is disadvantageous that the arrangement of the water pump at a front side of the crankcase results in an installation size of the entire engine that is too long for some applications.

SUMMARY OF THE INVENTION

It is an object of the present disclosure to avoid the above-named disadvantages and to create an internal combustion engine that has smaller installation dimensions, in particular with regard to its linear extension.

The present disclosure provides an internal combustion engine, including at least a cylinder head (1) including a water pump (2) that is integrated into the cylinder head housing. The present disclosure also provides a method for operating an internal combustion engine, characterized in that it includes an internal combustion engine as recited in one or multiple of the preceding claims.

BRIEF DESCRIPTION OF THE DRAWINGS

The present invention is elucidated below in greater detail based on two exemplary embodiments.

FIG. 3 shows a cylinder head including a thermostat in a top view.

FIG. 4 shows a section B-B from FIG. 3.

FIG. 5 shows a section C-C from FIG. 3.

FIG. 6 shows a module 15 from FIG. 3.

DETAILED DESCRIPTION

Figure 1:
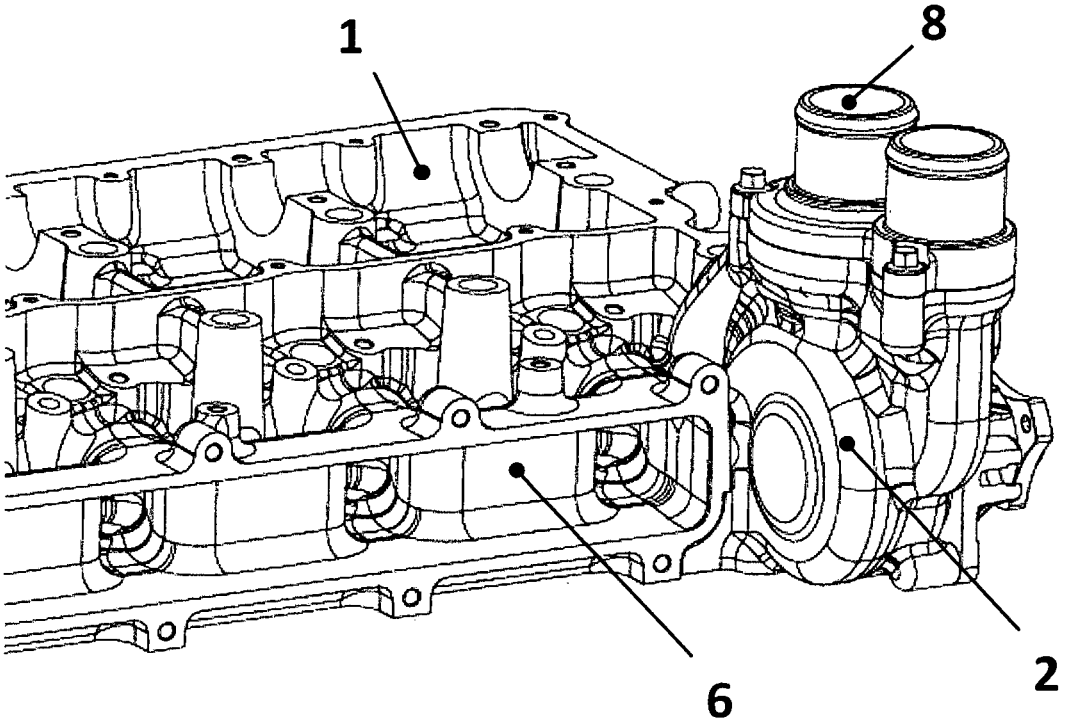
FIG. 1 shows a cylinder head including a water pump, a thermostat, and a connecting piece.

Cylinder head 1 illustrated in FIG. 1 includes a water pump 2 cast into cylinder head 1; this water pump 2 includes a thermostat 5 and a connecting piece 8.

When engines are developed, great value is set on compactness. In particular the length, height, and width of the engine is crucial to keep the devices compact, into which this engine is to be installed. One criterion for the engine length, width, and height is cylinder head 1 including the installation of water pump 2. Present-day constructions show consoles that are screwed in front of or at the cylinder crankcase and/or in front of or at cylinder head 1. The consoles accommodate parts of thermostats 5 and the lines of the water supply to water pump 2. These constructions need a sufficiently large installation space. Other constructions show water pumps 2 in cylinder crankcases that render the engine unusably wide in the steer angle range for tractor applications.

Figure 2:
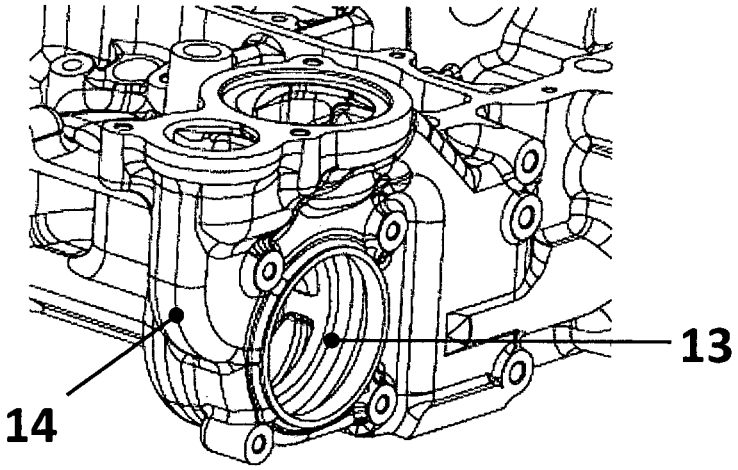
FIG. 2 shows a cylinder head including a water pump housing in a rotated view from FIG. 1.

FIG. 2 shows the rotated cylinder head including the water pump housing from FIG. 1.

In the present case, an approach is illustrated that considerably reduces the installation length, width, and height of the engine. In the case of a tractor application, there is nothing in the way in the steer angle range. This is achieved in that water pump housing 14, including water pump screw 9, pressure channel 4 and intake channel 3 is integrated into cylinder head 1. Intake channel 3, as illustrated in FIG. 4, pressure channel 4, and water pump screw 9, which is shown in FIG. 5, are cast into cylinder head 1. Impeller 10, drive shaft including a bearing 11, and housing cover 12, as shown in FIG. 6, of the pump are mounted into water pump housing 14 as module 15 via a front-side opening 13, as shown in FIG. 2. In this way, it is possible to place the water pump in very close proximity of the engine and, at the same time, to still leave enough space to arrange inlet channels 6, as seen in FIG. 1, at cylinder head 1. As a result of the high position of water pump 2, the design of the engine does not increase in width until higher levels, but it is still not as wide as in the case of a construction having an external water pump 2. The steer angle range of the tractor remains untouched. By arranging water pump 2 upstream from inlet channels 6 from FIG. 1, the engine length is reduced.

FIG. 3 shows a cylinder head 1 including thermostat 5 and module 15 in a top view.

Water pump 2 no longer determines the length of the engine. The additional integration of thermostat 5, as seen in FIG. 3, above water pump 2 saves space in height and long distances of water channels 7, which are an integral part of the entire cast body, including cylinder head 1 and water pump 2, and saves additional piping, as illustrated in FIG. 4, toward water pump 2, since water pump 2 is directly connected with the aid of water channel 7 with the cooling water volume of cylinder head 1 through a channel in the cylinder crankcase.

In FIG. 4, section B-B from FIG. 3 is described.

Only one connecting piece 8, as seen in FIG. 1, is necessary. With the aid of this construction, the sealing surfaces and the line lengths in the entire water system are reduced. The integration of water pump 2 into the head thus ensures, with the exception of the inlet and outlet lines toward the cooler, a for the most part lineless cooling system having fewer components and less sealing surfaces.

FIG. 5 shows section C-C from FIG. 3 including cylinder head 1, pressure channel 4, and water pump screw 9 as parts of module 15. Pressure channel 4 is directly connected with the water volume of the cylinder crankcase.

In FIG. 6, module 15 from FIGS. 3, 4, and 5 is illustrated with impeller 10, drive shaft including a bearing 11, and housing cover 12.

LIST OF REFERENCE NUMERALS

1 cylinder head
2 water pump
3 intake channel
4 pressure channel
5 thermostat
6 inlet channels
7 water channels
8 connecting piece
9 water pump screw
10 impeller
11 drive shaft including a bearing
12 housing cover
13 front-side opening
14 water pump housing
15 module

What is claimed is:

1. An internal combustion engine comprising:

a cylinder head including a cylinder head housing and a water pump integrated into the cylinder head housing, the cylinder head including a cast body, the water pump including a water pump housing, an entirety of the water pump housing being an integral part of the cast body of the cylinder head, the water pump includes an impeller positioned entirely inside the water pump housing.

2. The internal combustion engine as recited in claim 1, wherein the water pump housing has a front-side opening.

3. The internal combustion engine as recited in claim 1, wherein the water pump housing includes a water pump screw, a pressure channel and an intake channel.

4. The internal combustion engine as recited in claim 1, wherein the water pump includes at least one integrated thermostat positioned above the impeller.

5. The internal combustion engine as recited in claim 1, wherein the water pump includes a module fastened to a side of the water pump housing facing away from the cylinder head.

6. The internal combustion engine as recited in claim 5, wherein the module includes the impeller, a drive shaft including a bearing, and a housing cover.

7. The internal combustion engine as recited in claim 6, wherein the housing cover of the module is configured to be screwed to the water pump housing via screws.

8. The internal combustion engine as recited in claim 1, wherein the water pump is directly connected via a water channel with a cooling water volume of the cylinder head through a channel in a cylinder crankcase, a pressure channel of the water pump housing being directly connected with a cooling water volume of the cylinder crankcase.

9. A method for operating an internal combustion engine comprising:

providing the internal combustion engine as recited in claim 1;

pumping water using the water pump integrated into the cylinder head housing.

10. The internal combustion engine as recited in claim 1, wherein the water pump housing is taller than the cylinder head.

11. The internal combustion engine as recited in claim 1, wherein the water pump housing includes an opening facing away from the cylinder head for inserting the impeller therein, the impeller being connected to a housing cover as part of a module that is installable onto the water pump housing such that the housing cover covers the opening.

12. The internal combustion engine as recited in claim 11, wherein an upper end of the water pump housing includes a first upper end opening, the first upper end opening being vertically higher than the opening facing away from the cylinder head.

13. The internal combustion engine as recited in claim 12, wherein the water pump includes a connecting piece connected to the first upper end opening.

14. The internal combustion engine as recited in claim 12, wherein the water pump includes a thermostat within the water pump housing positioned above the impeller and below the first upper end opening.

15. The internal combustion engine as recited in claim 14, wherein the water pump includes a water pump screw extending downward from the thermostat.

16. The internal combustion engine as recited in claim 15, wherein the water pump includes a pressure channel extending upward from a bottom of the water pump housing upward toward the impeller.

17. The internal combustion engine as recited in claim 16, wherein the pressure channel extends upward into the water pump screw.

18. The internal combustion engine as recited in claim 13, wherein the upper end of the water pump housing includes a second upper end opening, the second upper end opening being fluidically coupled to an intake channel of the water pump.

19. The internal combustion engine as recited in claim 1, wherein the cylinder head includes inlet channels formed into an open face thereof, the water pump being arranged upstream of the inlet channels.

* * * * *